US007753459B2

(12) United States Patent
Kappler et al.

(10) Patent No.: US 7,753,459 B2
(45) Date of Patent: Jul. 13, 2010

(54) CLOSURE ASSEMBLY AND METHOD

(75) Inventors: Jerrod Aaron Kappler, Louisville, KY (US); Mark Anthony Rinaudo, Crestwood, KY (US); Justin P. Todd, Louisville, KY (US); Steven Paul, Louisville, KY (US); Brandon Wayne Coats, Georgetown, IN (US)

(73) Assignee: General Electric Company, Schenectady, NY (US)

( * ) Notice: Subject to any disclaimer, the term of this patent is extended or adjusted under 35 U.S.C. 154(b) by 507 days.

(21) Appl. No.: 11/560,541

(22) Filed: Nov. 16, 2006

(65) Prior Publication Data

US 2008/0116777 A1 May 22, 2008

(51) Int. Cl.
*A47B 95/00* (2006.01)

(52) U.S. Cl. ..... 312/333; 312/402

(58) Field of Classification Search ..... 312/401, 312/402, 404, 330.1, 333, 319.1, 246, 270.2; 62/302; 292/12, 13, 219, 224, 210, 304, 292/DIG. 11, DIG. 61

See application file for complete search history.

(56) References Cited

U.S. PATENT DOCUMENTS

| | | | | |
|---|---|---|---|---|
| 2,711,944 | A * | 6/1955 | Meek et al. | 312/333 |
| 5,015,048 | A * | 5/1991 | Brunnert | 312/319.1 |
| 5,020,868 | A * | 6/1991 | Brunnert | 312/319.1 |
| 5,207,781 | A | 5/1993 | Rock | |
| 5,302,016 | A * | 4/1994 | Lautenschlager et al. | 312/333 |
| 5,474,375 | A | 12/1995 | Hollenstein | |
| 5,580,138 | A | 12/1996 | Grabher | |
| 5,711,517 | A | 1/1998 | Kelly | |
| 6,254,205 | B1 * | 7/2001 | Wright et al. | 312/217 |
| 6,682,158 | B2 * | 1/2004 | Lai | 312/333 |
| 6,910,749 | B2 * | 6/2005 | Mueller | 312/333 |
| 7,108,340 | B2 * | 9/2006 | Lai | 312/334.46 |
| 7,240,978 | B2 * | 7/2007 | Kobayashi et al. | 312/333 |
| 7,387,351 | B2 * | 6/2008 | Nam | 312/402 |
| 7,552,982 | B2 * | 6/2009 | Beaudoin | 312/334.47 |
| 2004/0040212 | A1 * | 3/2004 | Kawabata et al. | 49/193 |
| 2005/0138956 | A1 * | 6/2005 | Okuda et al. | 62/441 |
| 2006/0261606 | A1 * | 11/2006 | Bella | 292/304 |
| 2009/0026902 | A1 * | 1/2009 | Jurja | 312/319.1 |

FOREIGN PATENT DOCUMENTS

| | | |
|---|---|---|
| WO | WO03083392 | * 10/2003 |

* cited by examiner

*Primary Examiner*—Darnell M Jayne
*Assistant Examiner*—Michael Calabrese
(74) *Attorney, Agent, or Firm*—Global Patent Operation; Douglas D. Zhang

(57) ABSTRACT

A closure assembly configured to urge a drawer of a refrigerator from an open position that permits access to an interior of the drawer toward a closed position that impedes access to the interior of the drawer. The closure assembly includes a cam block configured to be disposed on one of the drawer and a portion of the refrigerator other than the drawer. The cam block includes a cam surface. A cam member is configured to be disposed on the other one of the drawer and the portion of the refrigerator other than the drawer. The cam member includes a contact surface configured to contact the cam surface to urge the drawer from the open position toward the closed position.

17 Claims, 3 Drawing Sheets

CLOSURE ASSEMBLY AND METHOD

BACKGROUND OF THE INVENTION

The described technology relates to a closure assembly, such as for a drawer of a refrigerator, and more particular such as for a bottom freezer drawer of the refrigerator, and a corresponding method.

In a known refrigerator that includes a bottom freezer drawer, problems are caused by failure of the drawer to be or to remain completely closed. This failure may be due to user error (e.g. failure of the user to ensure that the drawer is closed after food is placed in or removed from the drawer), operation of the refrigerator (e.g., vibrations caused by operation of the refrigerator resulting in the opening of the drawer), or environmental conditions (e.g., temperature changes within or outside the drawer causing changes in pressure that result in the opening of the drawer). Obviously, the failure of the drawer to be or to remain completely closed results in increased energy usage by the refrigerator, as the refrigerator continues to operate in an attempt to keep the temperature within the freezer drawer at or below a predetermined minimum temperature, and results in food loss when the refrigerator is not successful in maintaining the minimum temperature.

For these reasons, it is desirable to provide a closing mechanism that closes the freezer drawer under certain conditions. Known closing mechanisms suffer from numerous disadvantages, however. For example, some closing mechanisms provide a closing force through an entire range of movement of the freezer drawer. Such a closing mechanism presents an annoyance to the user of the refrigerator, however, as the drawer is constantly being urged toward the closed position, even when the user desires that the drawer remain open. Other closing mechanisms rely on complex systems of springs and gears, integrated into rails on which the freezer drawer slides open and closed, to close the freezer drawer. As a result of this complexity and integration, maintenance, repair and replacement of such a closing mechanism is both complicated and expensive.

BRIEF DESCRIPTION OF THE INVENTION

As described herein, embodiments of the invention overcome one or more of the above or other disadvantages known in the art.

In an embodiment, a closure assembly is configured to urge a drawer of a refrigerator from an open position that permits access to an interior of the drawer toward a closed position that impedes access to the interior of the drawer. The closure assembly includes a cam block configured to be disposed on one of the drawer and a portion of the refrigerator other than the drawer. The cam block includes a cam surface. A cam member is configured to be disposed on the other one of the drawer and the portion of the refrigerator other than the drawer. The cam block includes a cam surface. A cam member is configured to be disposed on the other one of the drawer and the portion of the refrigerator other than the drawer. The cam member includes a contact surface configured to contact the cam surface to urge the drawer from the open position toward the closed position.

In another embodiment, a refrigerator includes a drawer and a closure assembly configured to urge the drawer from a open position that permits access to an interior of the drawer toward a closed position that impedes access to the interior of the drawer. The closure assembly includes a cam block disposed on one of the drawer and a portion of the refrigerator other than the drawer. The cam block includes a cam surface. A cam member is disposed on the other one of the drawer and the portion of the refrigerator other than the drawer. The cam member includes a contact surface configured to contact the cam surface to urge the drawer from the open position toward the closed position.

In another embodiment, a method of opening and closing a drawer of a refrigerator includes applying a closing force when the drawer is opened less than a first predetermined linear distance, and applying an opening force when the drawer is opened more than the first predetermined distance. Neither a closing force nor an opening force is applied when the drawer is opened more than a second predetermined linear distance that is greater than the first distance.

BRIEF DESCRIPTION OF THE DRAWINGS

The following figures illustrate examples of embodiments of the invention. The figures are described in detail below.

DETAILED DESCRIPTION OF EMBODIMENTS OF THE INVENTION

Embodiments of the invention are described below, with reference to the figures. Throughout the figures, like reference numbers indicate the same or similar components.

Figure 1:
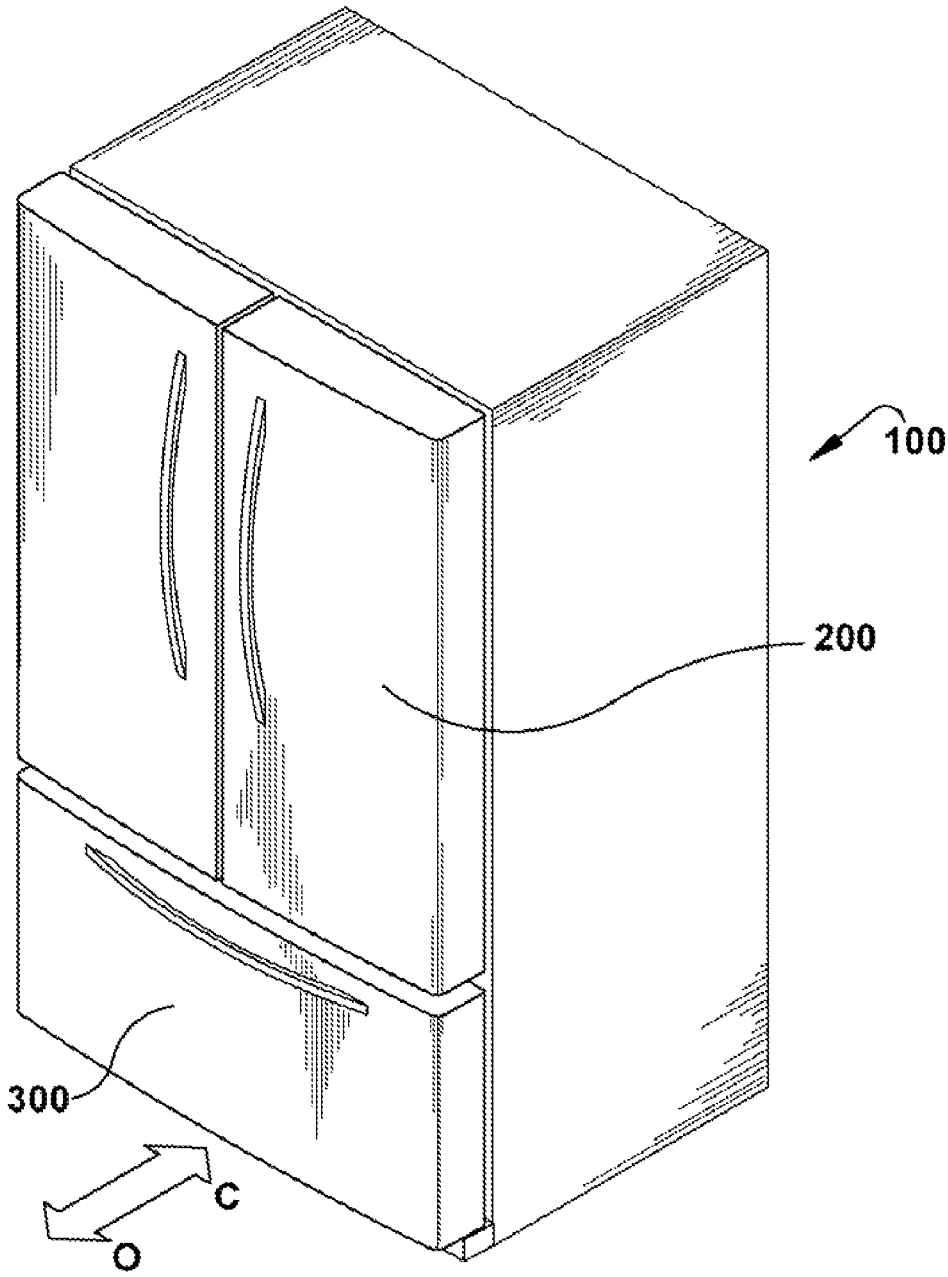
FIG. 1 is a front isometric view of a refrigerator including a bottom freezer drawer with a closure assembly.
Figure 2:
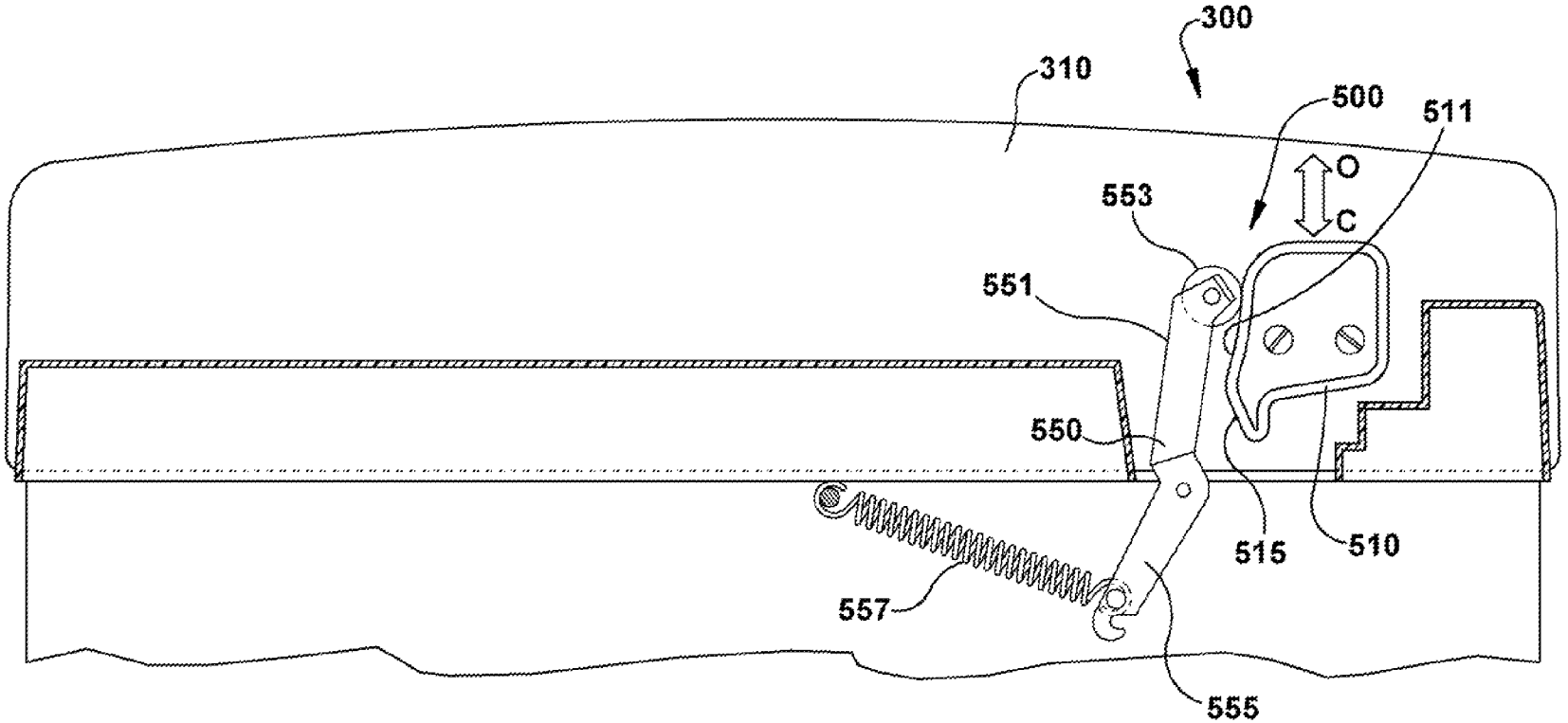
FIG. 2 is a bottom view of the bottom freezer drawer including the closure assembly of FIG. 1.
Figure 3:
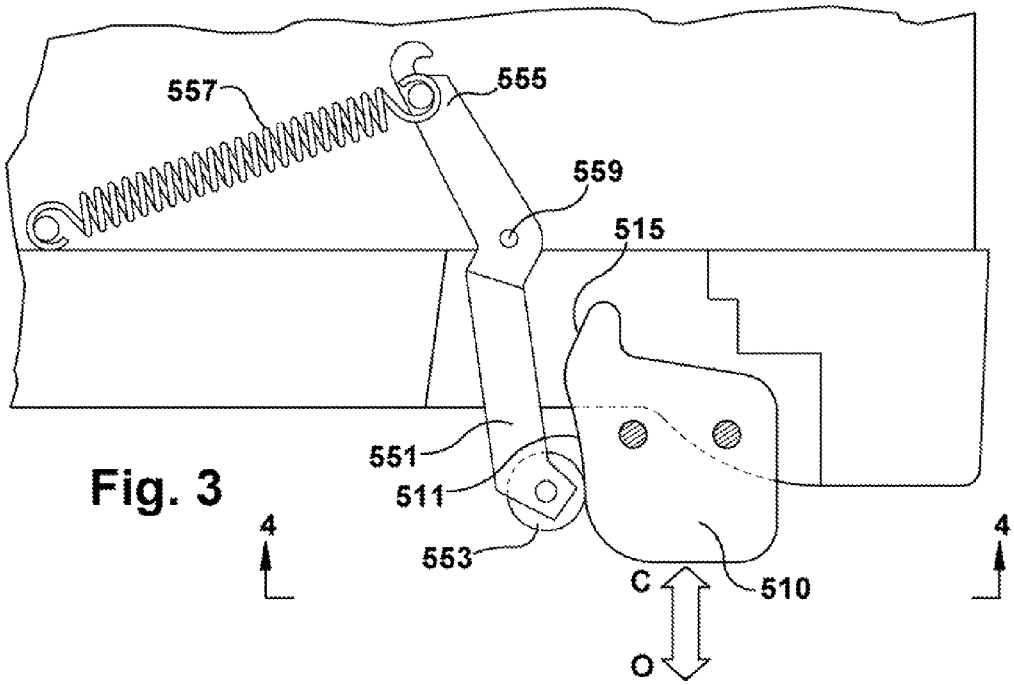
FIG. 3 is a top view of the closure assembly of FIG. 1, with the bottom freezer drawer removed.
Figure 4:
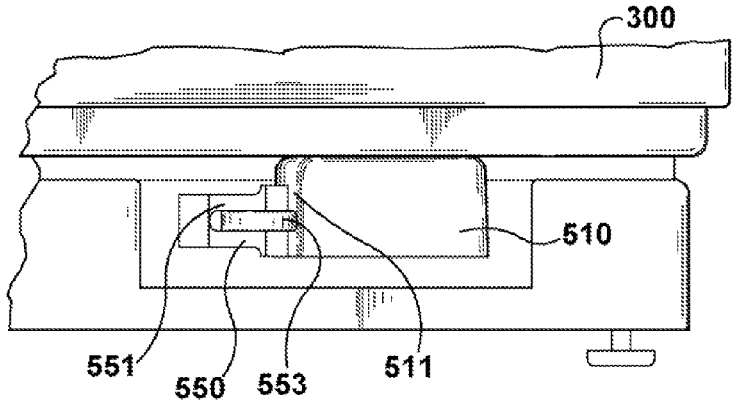
FIG. 4 is a front view of the bottom drawer including the closure assembly of FIG. 1.

FIG. 1 is a front isometric view of a refrigerator including a bottom freezer drawer with a closure assembly, and FIG. 2 is a bottom view of the bottom freezer drawer including the closure assembly of FIG. 1. FIG. 3 is a top view of the closure assembly of FIG. 1, with the bottom freezer drawer removed. FIG. 4 is a front view of the bottom drawer including the closure assembly of FIG. 1.

As shown in the figures, a refrigerator 100 can include a top fresh food cabinet 200 and a bottom freezer drawer 300 including a closure assembly 500. Although embodiments of the closure assembly 500 are described as being disposed and used on the bottom freezer drawer 300, it is to be understood that the closure assembly 500 is not limited to or required to be used with the bottom freezer drawer 300. Rather, the closure assembly 500 can be used with another drawer within the refrigerator 100, including but not limited to a drawer within the top fresh food cabinet 200 (such as a produce drawer), or a drawer within the bottom freezer drawer 300. It is also to be understood that the closure assembly 500 is not limited to use within the refrigerator 100 that includes the top fresh food cabinet 200 above the bottom freezer drawer 300, but rather can be used with a refrigerator that includes a freezer disposed on the left or right side of a fresh food compartment, or can be used with a refrigerator that includes a top freezer above a bottom fresh food compartment. Still further, it is to be understood that although embodiments of the invention describe the closure assembly 500 as being used with a drawer of the refrigerator 100, the closure assembly is not limited to use on a drawer, and is not limited to use with a refrigerator. Rather, the closure assembly 500 can be used in other contexts where it is desired to avoid disadvantages associated with failure of a component to maintain a desired position or orientation.

In embodiments shown in the drawings, the closure assembly 500 includes cooperating cam members 510 and 550. The cam members 510 and 550 include faces configured to cooperate with one another, such that the cam members 510 and 550 are urged in one or more directions relative to one another. Thus, when the cam members 510 and 550 are disposed on the bottom freezer drawer 300 and on a portion of the refrigerator 100 separate from the bottom freezer drawer 300, respectively, the bottom freezer drawer 300 is urged in a first direction (e.g., closed or open), under some set of conditions, relative to the refrigerator 100. Further, the bottom freezer drawer 300 can be urged in a second direction opposite the first direction, under some set of conditions.

Although the drawings show embodiments in which the cam member 510 is a cam block, and in which the cam member 550 is a lever arm, it is to be understood that the cam members 510 and 550 are not limited to being a cam block and a lever arm. Rather, each of the cam members 510 and 550 can be cam blocks cooperating with one another, or each can be a lever arm cooperating with one another. Further, it is to be understood that when the closure assembly 500 includes the cam block cooperating with the lever arm, the positions of the cam members are not limited or restricted to those shown in the drawings. For example, the lever arm can be disposed on the bottom freezer drawer 300, and the cam block can be disposed on the portion of the refrigerator 100 separate from the bottom freezer drawer 300. Still further, the respective locations of the cam members 510 and 550 on the bottom freezer drawer 300 and the refrigerator 100 can be varied.

In embodiment shown in the drawings, the cam block 510 is disposed on a bottom surface 310 of the bottom freezer drawer 300, such that the cam block 510 moves linearly with the corresponding linear movement of the bottom freezer drawer 300. The cam block 510 includes first and second cam surfaces 511 and 515. The first cam surface 511 cooperates with the lever arm 550 to urge the bottom freezer drawer 300 in a first direction C, under a first set of conditions. The cam block 510 and lever arm 550 are disposed such that the first direction C is the closed direction. The second cam surface 515 cooperates with the lever arm 550 to urge the bottom freezer drawer 300 in a second direction O, under a second set of conditions. The cam block 510 and the lever arm 550 are disposed such that the second direction O is the open direction. The first set of conditions includes when a portion of the lever arm 550 is in contact with and is urged toward the first cam surface 511, and the second set of conditions includes when a portion of the lever arm 550 is in contact with and is urged toward the second cam surface 515.

In specific embodiments of the invention, the cam surfaces 511 and 515 are sized, shaped, oriented and/or otherwise disposed such that when the bottom freezer drawer 300 is opened less than a predetermined linear distance, the lever arm 550 is in contact with and is urged toward the first cam surface 511, and the bottom freezer drawer 300 is urged in the direction C, such that the bottom freezer drawer 300 is closed. The cam surfaces 511 and 515 are further sized, shaped, oriented and/or otherwise disposed such that when the freezer drawer is opened more than the predetermined linear distance, the lever arm 550 is in contact with and is urged toward the second cam surface 515, and the freezer drawer is urged in the direction O, such that the bottom freezer drawer 300 is urged open. The lever arm 550 and the cam block 510 are also sized, shaped, oriented and/or otherwise disposed such that when the bottom freezer drawer 300 is open more than a predetermined minimum amount (i.e., a second predetermined linear distance), the lever arm 550 is out of contact with the cam block 510, and the bottom freezer drawer 300 is not urged either open or closed.

The lever arm 550 is configured to cooperate with the cam block 510, to urge the bottom freezer drawer 300 in the first direction C (the closed direction) and to urge the bottom freezer drawer 300 in the second direction O (the open direction). In embodiments shown in the drawings, the lever arm 550 includes a first end 551 and a second end 555. The first end 551 includes a contact surface 553 configured to contact the cam surface 511 and 515 of the cam block 510. Specifically, the contact surface 553 contacts the first cam surface 511 to urge the cam block 510 in the C direction, to close the bottom freezer drawer 300, and contacts the second cam surface 515 to urge the cam block 510 in the O direction, to open the bottom freezer drawer 300. The contact surface 553 can also be brought out of contact with the cam block 510 when the bottom freezer drawer 300 is opened more than the predetermined minimum amount, depending on the arrangement of the components of the closure assembly 500.

As shown in the drawings, the contact surface 553 can be in the form of a wheel member, configured to rotate on its axis during movement of the cam block 510 and the bottom freezer drawer 300 relative to the lever arm 550. The wheel member can be disposed on one protrusion, or between two protrusions, on the end of the first end 551 of the lever arm 550. As shown in the drawings, the first end 551 of the lever arm 550 can include two protrusions, including apertures, holes, slots or other voids, blind or through, circular or other shapes, in which an axle of the wheel member is disposed. By this arrangement, low friction is maintained between the lever arm 550 and the cam block 510.

The second end 555 of the lever arm 550 can be biased by a resilient member 557, such as, but not limited to, a tension or compression spring, such that the cam block 510 is urged to move relative to the lever arm 550. Specifically, the second end 555 of the lever arm 550 can be appropriately biased such that the first end 551 of the lever arm 550 is biased toward the cam block 510, and such that the contact surface 553 is urged to contact or to remain in contact with the cam block 510. In embodiments shown in the drawings, the lever arm 550 rotates on an axis, and in particular rotates on a pivot member 559. An example of a usable pivot member 559 includes a pin member, disposed in a void formed in, or otherwise connected to, the lever arm 550. By this arrangement, the contact surface 553 is urged along the first cam surface 511 to urge the cam block 510 in the C direction to close the bottom freezer drawer 300, and is urged along the second cam surface 515 to urge the cam block 510 in the O direction to open the bottom freezer drawer 300, depending on the position of the lever arm 550 as compared to the position of the cam block 510.

The cam block 510 can be connected to the bottom freezer drawer 300 by a variety of methods, including one or more mechanical fasteners (screws, pins, bolts, and the like), adhesives, or other methods that prevent the cam block 510 from undesired separation from the bottom freezer drawer 300. Also, the lever arm 550 can be connected to a portion of the refrigerator 100 by a variety of methods. As discussed above, it is contemplated that although not shown in the drawings, in an embodiment the lever arm 550 can be connected to the bottom freezer drawer 300 and the cam block 510 can be connected to the refrigerator 100.

In embodiments of the invention, it is contemplated that a force required to open the bottom freezer drawer 300, required in part by the lever arm 550 being urged against the first cam surface 511 of the cam block 510, is less than about 15 pounds-force (66.7 N). It is to be understood that a variety of factors can influence or affect the force required to open the bottom freezer drawer 300 including the closure assembly 500, such factors including but not limited to characteristics of any or all of the first cam surface 511, the lever arm 550, the contact surface 553, and the resilient member 557, as well as other characteristics of the refrigerator 100, the bottom freezer drawer 300, and/or the closure assembly 500.

The closure assembly 500 optionally engages a light switch and/or an alarm switch. The light switch can be connected to a lighting system that illuminates an interior of the bottom freezer drawer 300 when the bottom freezer drawer 300 is opened. The light switch can be operated through contact or the absence of contact with the cam block 510 or the lever arm 500. The alarm switch can be connected to an alarm system that operates an alarm to alert a passer-by when the bottom freezer drawer 300 is not completely closed. The alarm switch can be operated through contact or the absence of contact with the cam block 510 or the lever arm 500. The alarm switch can be the same switch as the light switch, or can be separate from the light switch. The above-discussed predetermined linear distance can correspond to engagement of the light switch and/or the alarm switch, such that the light switch is engaged when the bottom freezer drawer 300 is opened more than the predetermined linear distance.

Throughout the description, the terms "open" and "closed," and variations thereof, are used. It is to be understood that these terms are understood to respectively include a position that permits access to an interior of the bottom freezer drawer 300, and a position that impedes (e.g., limits or prohibits) access to the interior of the bottom freezer drawer 300. The terms are also used in a relative sense, such that movement from a position allowing a degree of access to the interior of the bottom freezer drawer 300 to a position allowing a lesser degree of access to the interior is movement in, to or toward the "closed" position, while movement from a position allowing a degree of access to the interior of the bottom freezer drawer 300 to a position allowing a greater degree of access to the interior is movement in, to, or toward the "open" position.

The term "drawer" and variations thereof are also used throughout the description. It is understood that this term includes a compartment with a bottom and one or more side walls. It is also understood, however, that the term includes a component that is drawn regardless of whether the component includes a bottom or side walls, such as a shelf.

This written description uses examples to disclose embodiments of the invention, including the best mode, and also to enable a person of ordinary skill in the art to make and use embodiments of the invention. It is understood that the patentable scope of embodiments of the invention is defined by the claims, and can include additional components occurring to those skilled in the art. Such other arrangements are understood to be within the scope of the claims.

The invention claimed is:

1. A refrigerator comprising:

a drawer; and a closure assembly comprising:

a cam block disposed on one of the drawer and a portion of the refrigerator other than the drawer, the cam block comprising a first cam surface and a second cam surface; and a cam member disposed on the other of the drawer and the portion of the refrigerator other than the drawer, the cam member comprising a contact surface, wherein when the drawer is opened less than a first predetermined linear distance, the contact surface is biased to engage the first cam surface so that the contact surface and the first cam surface cooperate with each other to apply a closing force on the drawer, and wherein when the drawer is opened more than the first predetermined linear distance, the contact surface is biased to engage the second cam surface and the contact surface and the second cam surface cooperate with each other to generate an opening force on the drawer.

2. The refrigerator of claim 1, wherein the cam member comprises a lever arm rotatable about an axis.

3. The refrigerator of claim 2, further comprising a resilient member biasing the contact surface toward the cam block.

4. The refrigerator of claim 3, wherein the resilient member comprises a spring.

5. The refrigerator of claim 3, wherein the lever arm comprises a first end, a second end, and a wheel member mounted on the first end and comprising the contact surface, the axis being disposed between the first end and the second end, the second end being connected to the resilient member.

6. The refrigerator of claim 2, wherein the cam member further comprises a wheel member disposed on the lever arm, the wheel member comprising the contact surface.

7. The refrigerator of claim 1, wherein the cam block is disposed on the drawer and the cam member is disposed on the portion of the refrigerator other than the drawer.

8. The refrigerator of claim 1, wherein when the drawer is opened more than a second predetermined linear distance greater than the first predetermined linear distance, the contact surface does not engage the cam block so that neither a closing force nor an opening force is applied on the drawer.

9. An apparatus comprising:

a drawer; and a closure assembly comprising:

a cam block disposed on one of the drawer and a portion of the apparatus other than the drawer, the cam block comprising a first cam surface and a second cam surface; and a cam member disposed on the other of the drawer and the portion of the apparatus other than the drawer, the cam member comprising a contact surface, wherein when the drawer is opened less than a first predetermined linear distance, the contact surface is biased to engage the first cam surface, and the contact surface and the first cam surface cooperate with each other to apply a closing force on the drawer, and wherein when the drawer is opened more than the first predetermined linear distance, the contact surface is biased to engage the second cam surface, and the contact surface and the second cam surface cooperate with each other to generate an opening force on the drawer.

10. The apparatus of claim 9, wherein the cam member comprises a lever arm rotatable about an axis.

11. The apparatus of claim 10, further comprising a resilient member biasing the contact surface toward the cam block.

12. The apparatus of claim 11, wherein the resilient member comprises a spring.

13. The apparatus of claim 11, wherein the lever arm comprises a first end, a second end, and a wheel member mounted on the first end and comprising the contact surface, the axis being disposed between the first end and the second end, the second end being connected to the resilient member.

14. The apparatus of claim 10, wherein the cam member further comprises a wheel member disposed on the lever arm, the wheel member comprising the contact surface.

15. The apparatus of claim 10, wherein the apparatus is a refrigerator.

16. The apparatus of claim 9, wherein the cam block is disposed on the drawer and the cam member is disposed on the portion of the refrigerator other than the drawer.

17. The apparatus of claim 9, wherein when the drawer is opened more than a second predetermined linear distance greater than the first predetermined linear distance, the contact surface does not engage the cam block so that neither a closing force nor an opening force is applied on the drawer.

* * * * *